United States Patent [19]

Dobson

[11] Patent Number: 4,928,321

[45] Date of Patent: May 29, 1990

[54] HOOD AND HOODED GARMENT

[76] Inventor: Marguerite A. R. Dobson, 43 Tredegar Square, London, England, E3 5AE

[21] Appl. No.: 269,992

[22] Filed: Nov. 10, 1988

[30] Foreign Application Priority Data

Nov. 10, 1987 [GB] United Kingdom ..... 8726249

[51] Int. Cl.[5] ..... A41D 3/02

[52] U.S. Cl. ..... 2/84; D2/185; D2/79

[58] Field of Search ..... 2/84, 171, 202, 204, 2/205, 199; D2/26, 79, 80, 81, 83, 185, 189, 256, 509, 515; D3/13; 434/99; 446/268, 474

[56] References Cited

U.S. PATENT DOCUMENTS

| | | | |
|---|---|---|---|
| D. 64,439 | 4/1924 | Browne | D2/79 |
| D. 162,159 | 2/1951 | Harfenist | D3/13 |
| D. 168,822 | 2/1953 | Bland | 2/84 |
| D. 268,744 | 4/1983 | Gibsone | D2/79 |
| D. 283,172 | 4/1986 | Johnson | D2/79 |
| D. 285,815 | 9/1986 | Finn | D2/185 |
| 1,292,351 | 1/1919 | Milkes | 2/84 |
| 2,492,003 | 12/1949 | Peckinpaugh | D2/185 |
| 2,705,803 | 4/1955 | Sheldrick | D2/81 |
| 3,698,014 | 10/1972 | Little | 2/84 |
| 4,498,199 | 2/1985 | Margolis | 2/84 |
| 4,543,669 | 10/1985 | Katz | 2/84 |

*Primary Examiner*—Werner H. Schroeder
*Assistant Examiner*—Diana L. Biefeld
*Attorney, Agent, or Firm*—Lerner, David, Littenberg, Krumholz & Mentlik

[57] ABSTRACT

A hood having a face opening in the front portion and an opposite facing rear portion has indicia on the rear portion suggesting the appearance of an animal, human, or other face. The markings may be drawn, painted or embroidered onto the surface of the hood, but features such as simulated eyes, noses and ears may give greater realism in appearance. The hood may form an integral part of, or be attachable to, a garment, such as child's coat.

2 Claims, 4 Drawing Sheets

HOOD AND HOODED GARMENT

This invention relates to a hood and to a garment having a hood integrally formed therewith or attached thereto.

It is known that children and sometimes adults like to dress up in animal costumes—see Patent Specification No. CB-A-1225200 for an example of such costume. An object of the invention is to provide such a costume with appeal especially to young children that enables them to dress up as an animal without a face mask having eye holes.

According to the invention, a hood of the type having a face opening in the front thereof has on at least one surface thereof indicia suggesting the appearance of an animal, human or other face.

While markings may be drawn, painted or embroidered onto the surface of the hood, greater realism may be achievable by the use of simulated eyes, noses and ears suitably formed, for example, from fabric or a plastic material. The use of simulated eyes formed from moulded plastic is particularly desirable where the appearance of a teddy bear or other toy animal is to be simulated. Additionally, the structure of the hood may be adapted to reproduce desired facial or other features.

Preferably the hood is arranged to give the appearance, when viewed from the rear, of a completed head. As an example, the head of an animal may be simulated.

The invention also provides a garment having integrally formed therewith or attached thereto a hood in accordance with the invention. The garment is suitably a child's coat, which may be further modified to give the appearance, when viewed from the rear, of, for example, an animal body. For example, the coat may be formed from a fur fabric, simulating the appearance of animal fur.

It has been found that the appearance of the coat in accordance with the invention encourage children who are normally reluctant to wear any form of headwear to keep the hood thereof on their head. The coat is thus of practical advantage, as well as being of novel and attractive appearance. It also has play value to children when not in use and can serve as a soft toy.

Reference is made to the drawings, in which.

Figure 1:
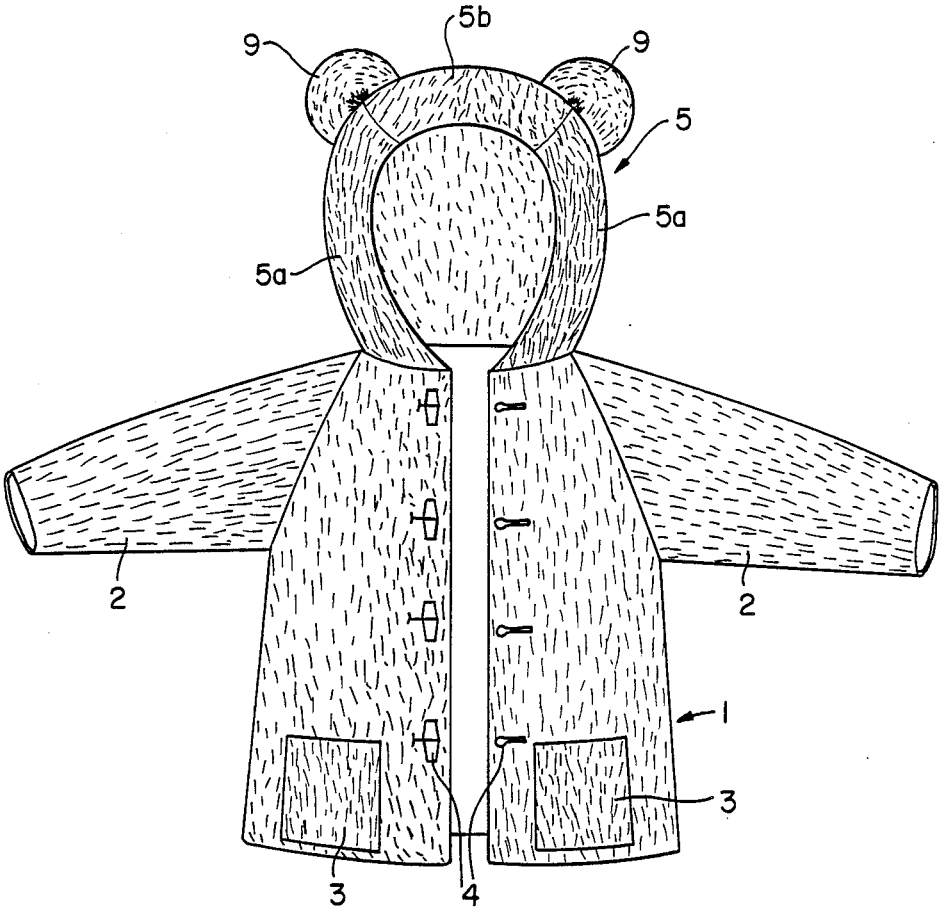
FIG. 1 is a front view of a child's coat in accordance with one embodiment of the present invention.

The coat 1 is of generally conventional construction, having, for example as illustrated, raglan sleeves 2 which have been selected to give the coat a more animal or bird-like appearance, patch pockets 3, and toggle and loop fastenings 4. The attached hood 5 is suitably formed from two identical side pieces 5*a* and a centre piece 5*b*. The garment is suitably formed from a fur fabric (e.g. a sliver-knit fur fabric), but any conventional coat fabric may be used, the hood being of the same or a different fabric.

Figure 2:
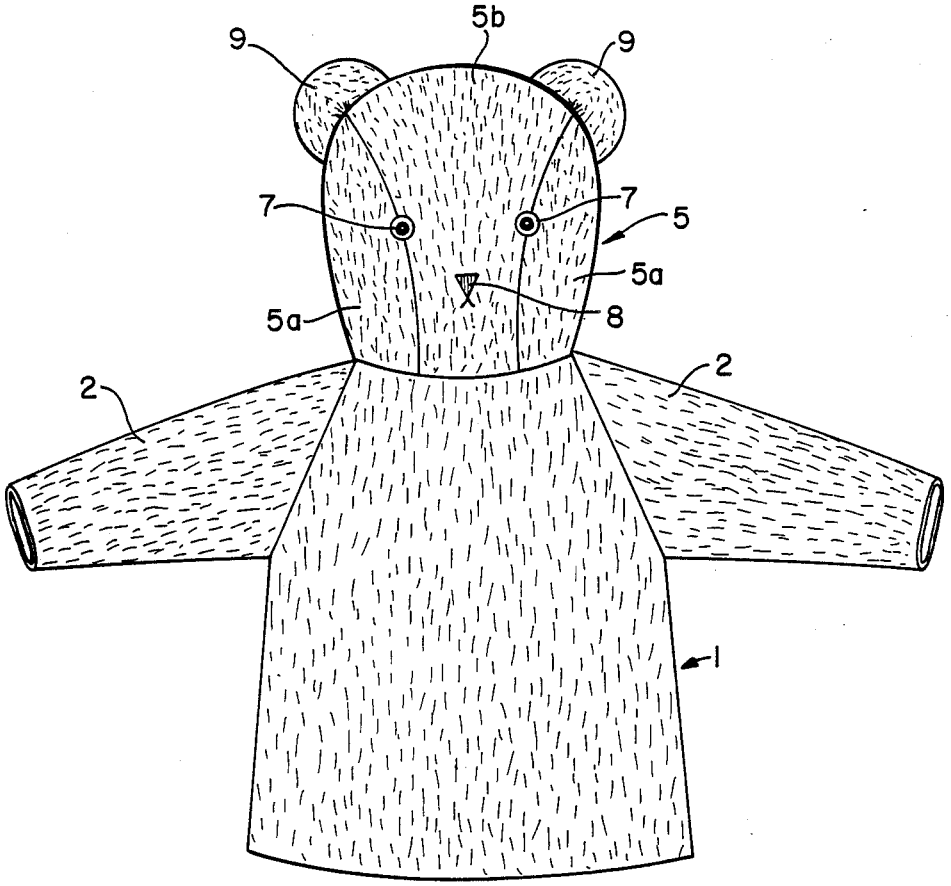
FIG. 2 is a rear view of the coat shown in FIG. 1.

Referring to FIG. 2, on the rear of the hood 5, a pair of plastic eyes 7 such as are used for soft toys is attached, and a nose/mouth shape 8 is formed from stitches of wool. For attachment of the eyes to the hood, a stem of each plastics eye may have a locking washer pushed onto it, after which the protruding part of the shaft is flattened by the action of heat and pressure to present a bluff surface to the head of the wearer. Fabric ears 9 are attached to the top of the hood so that, from the rear, the hood gives the appearance of a teddy bear head with the remainder of the coat appearing as the body of the teddy bear.

Figure 3:
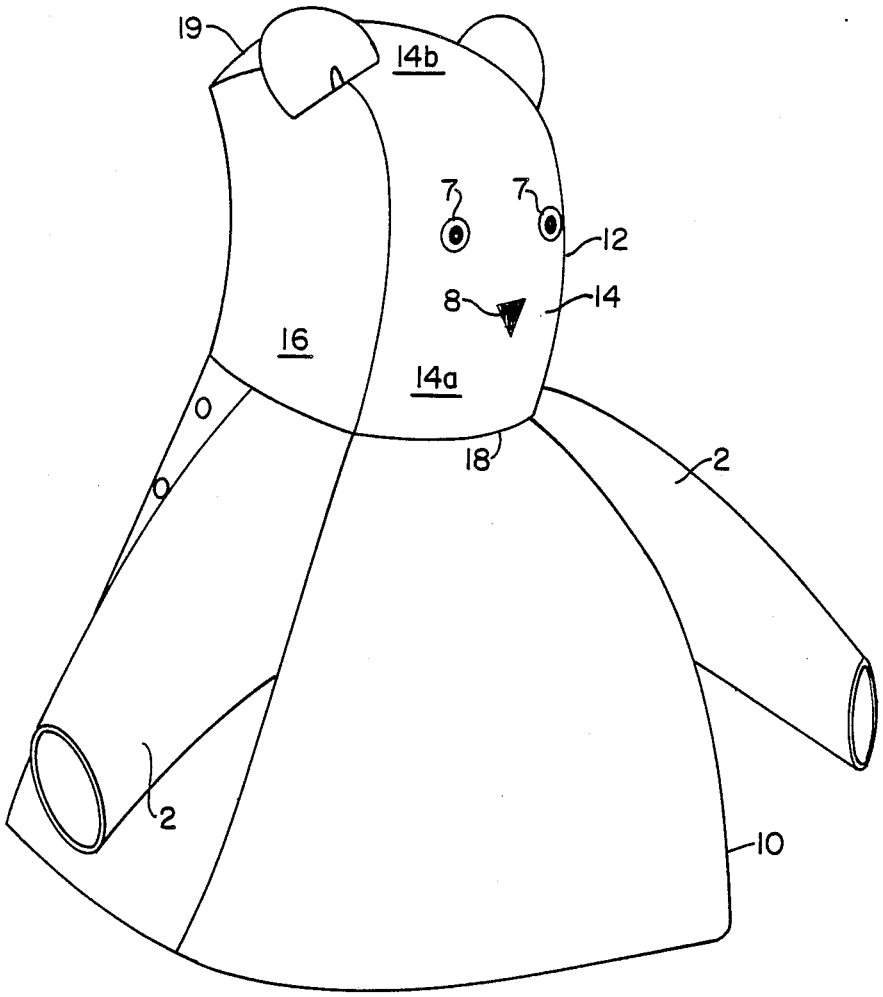
FIG. 3 is a rear perspective view of a second embodiment of the child's coat.
Figure 4:
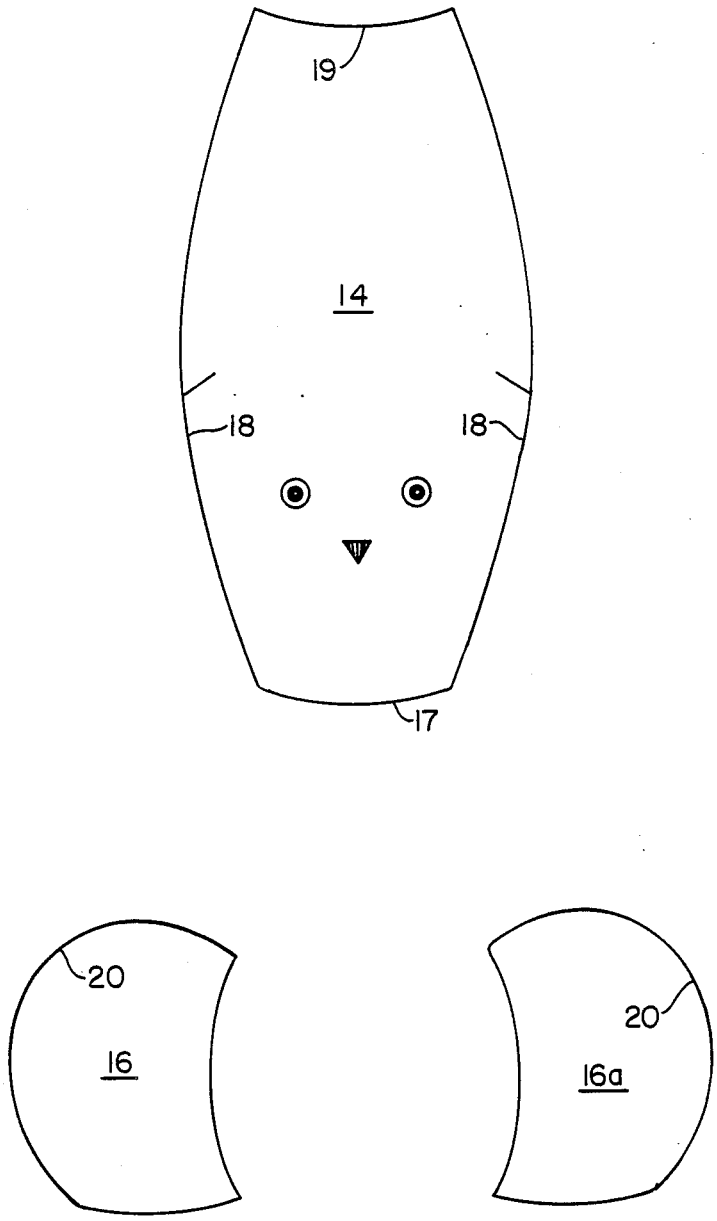
FIG. 4 diagrammatically illustrates portions for making the hood of the coat of FIG. 3.

In FIGS. 3 and 4 a coat 10 has a hood 12 that comprises a relatively long, relatively wide centre piece 14 and relatively short shape—defining side pieces 16 and 16*a*. The centre panel 14 has a convex curved base edge 17 for attachment at neck seam 21, convexly curving side edges 18 and a concave front edge 19. The side pieces 16, 16*a* have edges 20 to which the side edges 18 of centre piece 14 are joined and which define the shape of the hood. The lower region 14*a* of piece 14 tends to retain a somewhat flattened shape up to the position where fabric ears 9 are attached, above which there is a fairly abrupt fold leading to top region 14*b* which rests on the head. Because of its construction coupled with the relatively thick fur or other fabric of which the hood 12 is made, the hood 12 provides a simulation of an animal head shape and tends to retain a degree of shape even when the hood 12 is collapsed or the coat is not being worn. The eyes 7 and nose/mouth 8 now appear wholly on the centre piece 14. This panel structure of the hood 12 has been found to give a greater degree of realism than other two or three piece structures, inter alia, because the seams between pieces 14, 16, and 16*a* occur at the sides of the head and define relatively abrupt folds of the hood bounding the central panel 14.

It will be appreciated that, by using different combinations of eye, nose, mouth and ear designs and colours, hoods or coats giving the appearance of a wide variety of different toy or real animals may be produced. For example, the hood or coat may be adapted to give the appearance of a cat, a panda, a rabbit, a leopard, a tiger or an owl, but the invention is not limited to these animals.

The garment encourages children to wear it with the hood up, and the child's face is still kept cool. The garment also serves as a toy—when reversed it can be sat in a chair and provides the appearance of a sitting animal. If the child wears the garment reversed, it can also be manipulated somewhat like a large puppet.

I claim:

1. A garment comprising, a body portion, and a hood, said hood having oppositely facing front and rear portions, a center panel extending from said front portion to said rear portion, and at least two side panels, said center panel being attached at lateral edges to said side panels, said front portion having a face opening therein and said rear portion having indicia suggesting the appearance of a single face covering substantially the entirety of said rear portion of said hood, said body portion of said garment including a neck seam, and at least two raglan sleeves, said at least two raglan sleeves being separated by a spaced distance along said neck seam, said center panel of said hood joining said body portion at said neck seam along said spaced distance between said raglan sleeves, wherein said center panel of said hood extends along said neck seam from one of said raglan sleeves to the other of said raglan sleeves.

2. A garment according to claim 1 formed from a fur material.

* * * * *